US012428258B2

(12) United States Patent
Birdwell

(10) Patent No.: US 12,428,258 B2
(45) Date of Patent: Sep. 30, 2025

(54) METHOD AND APPARATUS FOR WINDING A CABLE

(71) Applicant: Michael Birdwell, Jacksonville, TX (US)

(72) Inventor: Michael Birdwell, Jacksonville, TX (US)

( * ) Notice: Subject to any disclaimer, the term of this patent is extended or adjusted under 35 U.S.C. 154(b) by 438 days.

(21) Appl. No.: 17/958,783

(22) Filed: Oct. 3, 2022

(65) Prior Publication Data

US 2024/0109749 A1 Apr. 4, 2024

(51) Int. Cl.
*B65H 75/22* (2006.01)
*B65H 54/40* (2006.01)
*B65H 79/00* (2006.01)

(52) U.S. Cl.
CPC ..... *B65H 75/2209* (2021.05); *B65H 54/40* (2013.01); *B65H 79/00* (2013.01)

(58) Field of Classification Search
CPC ..... B65H 75/2495
See application file for complete search history.

(56) References Cited

U.S. PATENT DOCUMENTS 1,827,855 A 10/1931 Parker
1,862,598 A * 6/1932 Livermore ..... B66D 1/30 242/574.4
1,915,133 A * 6/1933 Larsen ..... B65H 59/04 242/396.9
2,318,906 A 5/1943 Troche et al.
2,341,722 A * 2/1944 Kelleher ..... F16H 55/50 242/574.4
2,361,258 A * 10/1944 Bromm ..... B65H 54/58 242/603
2,459,336 A * 1/1949 Powell ..... B65H 75/2218 242/574.4
2,624,771 A * 1/1953 Hanson ..... B65H 54/58 439/409
2,877,962 A * 3/1959 Powers ..... B65H 75/24 242/574
3,415,460 A * 12/1968 Macknick ..... B21C 47/14 242/607
5,025,999 A * 6/1991 Littrell ..... H02K 15/0431 242/604

(Continued)

FOREIGN PATENT DOCUMENTS

DE 20 2020 107 393 * 2/2021

*Primary Examiner* — William A. Rivera
(74) *Attorney, Agent, or Firm* — Vincent J. Allen; Carstens, Allen & Gourley, LLP

(57) ABSTRACT

A cable winding apparatus mounted on an arm of an excavator. The cable winding apparatus comprises a housing, a hydraulic motor disposed within the housing where a portion of the hydraulic motor extends through the second wall of the housing, a drive shaft extending through the housing that is connected to the motor, and a collapsible power reel. The collapsible power reel comprises a plurality of segments movably coupled to the collapsible power reel and extending radially from the collapsible power reel. The plurality of segments can engage a cable and enable the cable to be wound around the collapsible power reel as the hydraulic motor rotates the collapsible power reel. The plurality of segments are configured to collapse in an axial direction, thereby enabling the wound cable to be easily removed from the apparatus.

20 Claims, 6 Drawing Sheets

(56) References Cited

U.S. PATENT DOCUMENTS

| | | | | |
|---|---|---|---|---|
| 5,238,225 | A | 8/1993 | Hunt | |
| 5,409,179 | A * | 4/1995 | Leclerc | B65H 75/2209 242/573 |
| 5,549,257 | A * | 8/1996 | Sanda | B65H 75/28 242/580 |
| 5,653,293 | A | 8/1997 | Ellis | |
| 5,711,636 | A | 1/1998 | Boyer | |
| 6,152,425 | A | 11/2000 | Boyer | |
| 6,494,437 | B1 | 12/2002 | Boyer | |
| 6,553,694 | B2 | 4/2003 | Martinez | |
| 10,008,838 | B1 | 6/2018 | Rhodes et al. | |
| 10,431,965 | B2 | 10/2019 | Palmer et al. | |
| 10,464,790 | B1 | 11/2019 | Brutaru | |
| 2007/0131815 | A1 * | 6/2007 | Bordignon | B21C 47/30 242/472.5 |
| 2009/0260265 | A1 | 10/2009 | Aeschbacher et al. | |
| 2019/0245331 | A1 | 8/2019 | Palmer et al. | |
| 2024/0051783 | A1 * | 2/2024 | Hillenmaier | B66C 3/005 |

* cited by examiner

METHOD AND APPARATUS FOR WINDING A CABLE

BACKGROUND

Technical Field

The present disclosure relates to a novel system and method for cable pulling. More particularly, and not by way of limitation, the present disclosure is directed to a system and method for cable pulling that is attached to an excavator and can wind a cable onto a reel.

Description of Related Art

Cable-pulling apparatuses permit a cable to be pulled through various mediums, such as a pipe, a conduit, or a container. Also, such devices can serve as an organizational mechanism to wrap the cable in an orderly fashion. While small projects can allow the cable to be pulled by hand, larger or more sophisticated jobs can be assisted by a cable-pulling apparatus.

Generally, cable pulling apparatuses have, in some manner, a spool that spins to pull or push on a cable. The pulling action can be achieved by human or machine strength. Often machines have used pneumatic systems, though these systems often have a length restriction on the size of job possible with the machine. In action, a cable puller is transported to the job site and needs to be run off either construction implements or another host vehicle. Another common application of the apparatus involves hooking the cable puller up to an excavator to utilize the moveable front trunk. The spool can have various embodiments to pull a cable and potentially provide a braking mechanism. The housing and spool can be attached to the bucket of an excavator or take the place of a bucket on an excavator.

In the construction industry, the ability to work quickly and efficiently is at a premium. Job sites are often in remote or undeveloped sites requiring cable pulling apparatuses to be operable and transportable to job site locations. Also, greater power and torque by a cable puller translates to increased pulling speed and capability. Further, the construction industry works on dead cables, and as such, the cable puller needs to be set up, executed, and deconstructed as quickly as possible. Typical embodiments have sought to provide cable pulling capabilities in a more efficient, powerful, or speedy fashion for construction practitioners.

It would be advantageous to have a system and method for cable pulling that overcomes the disadvantages of the prior art. The present disclosure provides such a system and method.

BRIEF SUMMARY

Novel aspects of the present disclosure are directed to a cable pulling apparatus. In a non-limiting embodiment, the apparatus improves performance over past cable pulling designs. The apparatus includes a housing that can be attached to an excavator. The motor may be attached to the housing on the opposite housing side to the power reel spool. Apertures on either side of the housing allow for the drive shaft to connect to the motor and the power reel spool on either side of the housing. The power reel spool can expand and contract radially. The present disclosure includes the balancing effect of placing the motor outside the housing opposite the power reel spool. This placement promotes balance, efficiency, and speed of operation for the cable pulling apparatus.

In another aspect, the present disclosure is directed towards the power reel spool to collect the cable. The spool can contract and expand the segments radially, allowing the cable to be removed from the spool without having to reverse the cable out of a wound position.

In another aspect, the present disclosure is directed towards the power reel spool and bucket embodiment, including a quick connect to connect the apparatus to the excavator. This allows the housing to be quickly attached or removed from an excavator. Also, the quick connect between power reel and the rest of the apparatus allows for the power reel spool to be disconnected from the housing and drive shaft with similar enhanced speed.

Other aspects, embodiments, and features will become apparent from the following detailed description when considered in conjunction with the accompanying figures. In the figures, each identical, or substantially similar component that is illustrated in various figures is represented by a single numeral or notation. For purposes of clarity, not every component is labeled in every figure. Nor is every component of each embodiment shown where illustration is not necessary to allow those of ordinary skill in the art to understand the present disclosure.

BRIEF DESCRIPTION OF THE DRAWINGS

The novel features believed characteristic of the disclosure are set forth in the appended claims. The disclosure itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Cable pullers have traditionally been used to collect or pull wire through a conduit but have struggled due to design constraints or job characteristics to efficiently aid in completing the job. Being overly large, cable pullers have commonly been considered out of the question if work is being completed in a remote area or if the cable puller must be transported a long distance due to the bulk and cost associated with transport.

Further, the power and capabilities of common designs sometimes limit the usefulness of a cable puller due to the length of pulling necessary, the power needed, or alternatives available, such as human strength. Without the ability to use machinery or power onsite, cable pullers also tended to lack value on a construction site when lacking connection of previously connected structures to the grid. Also, depending on the location, a cable puller needed to be mobile enough to get into position. Trailers, cars, and other common machinery sometimes lack the ability to orient the cable puller for the most efficient operation of the present disclosure.

The design of a cable may limit the speed at which a crew can complete a job. For example, the crew may be limited by the power or torque available in the cable puller. Too little power or torque is prohibitive, and too much could tear up the newly built infrastructure. There is also the concern of setup time as the cable puller must be assembled on the construction site. Any advancements to speed up the cable pulling process are helpful for the crew and make the cable puller more valuable.

The present disclosure overcomes these deficiencies by incorporating numerous features to improve the power, torque, and balance of the cable puller. Also, features have been added to allow for quick setup and breakdown of the cable puller. Further, added functionality to allow for power reel collapsibility improves speed and practicality for removing a cable from the power reel after the cable has been wrapped into place.

Figure 1A:
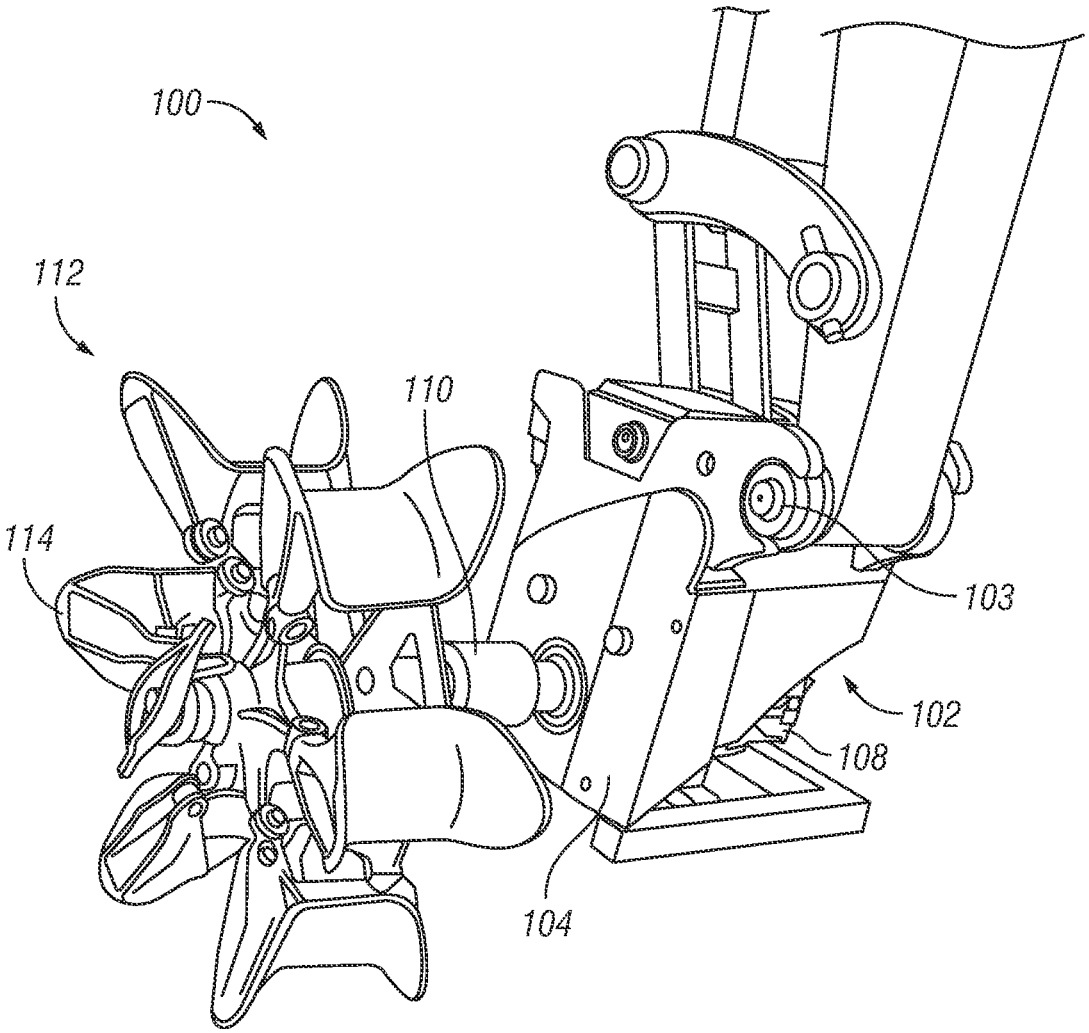
FIG. 1A is a backside view of the cable pulling apparatus of the present disclosure.

FIG. 1A is a rear view of an exemplary cable pulling apparatus of the present disclosure. When attached to a cable such as a wire or rope, the cable puller 100 can pull and orderly wrap a cable 119 as required by the project.

The cable puller 100 includes a first side wall 104 and a second side wall 106 of the housing 102. The housing 102 may be connected via a quick connect 103 to an excavator 101 to allow for easy attachment and removal of the cable puller 100. The housing 102 provides a foundation to hold a motor 108 on the second side wall 106 of the housing 102. Adjacent to the first side wall 104 is a convertible power reel 112. A drive shaft 110 provides a connection between the motor 108 and the convertible power reel 112 by running through the housing 102. In this example, the convertible power reel 112 is formed by numerous segments 114 extending in a radial direction to provide an area to interact with a cable.

The motor 108 is on the opposite side of the housing 102 from the collapsible power reel 112 providing balance to the cable puller 100 as it is attached to the excavator 101. Balance allows the cable puller 100 to work at higher power and torque than less balanced or structurally sound designs. Balance is achieved by evenly distributing the motor 108 and the collapsible power reel 112 across the housing 102 rather than having a cantilevered style design.

Figure 1B:
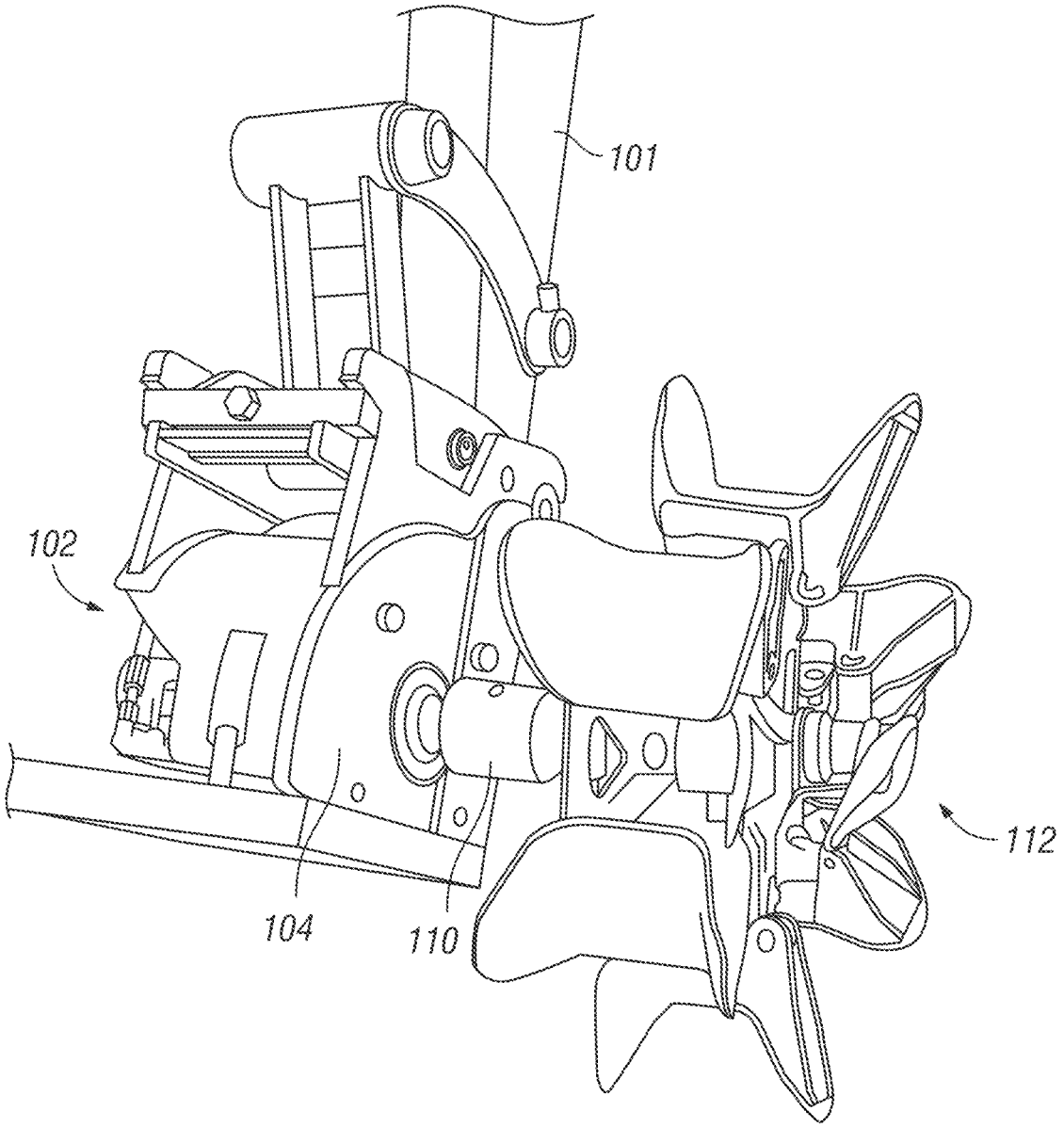
FIG. 1B is a front and right side view of the cable pulling apparatus of the present disclosure.

FIG. 1B provides a front and right side view of an exemplary cable pulling apparatus 100. The cable puller 100 in the foreground is attached to the excavator 101 in the background to provide mobility and usability as an accessory to common construction equipment on a job site.

FIGS. 1A and 1B also illustrate an example of an excavator 101 that is connected to the housing 102 via quick connects 103. The housing 102 has a first side wall 104 that allows the drive shaft 110 to extend out of an aperture in the first side wall 104. The drive shaft 110 is connected to the collapsible power reel 112. The collapsible power reel 112 has numerous segments 114 that extend from the collapsible power reel 112 in a radial direction. The housing 102 provides a foundation for a motor 108. The motor 108 may extend through the second side wall 106 side of the housing 102. Adjacent to the first side wall 104 is a collapsible power reel 112. A drive shaft 110 provides a connection between the motor 108 and the collapsible power reel 112 through the housing 102. In this example, the collapsible power reel 112 is formed by numerous segments 114 extending in a radial direction to provide an area to interact with a cable.

Figure 1C:
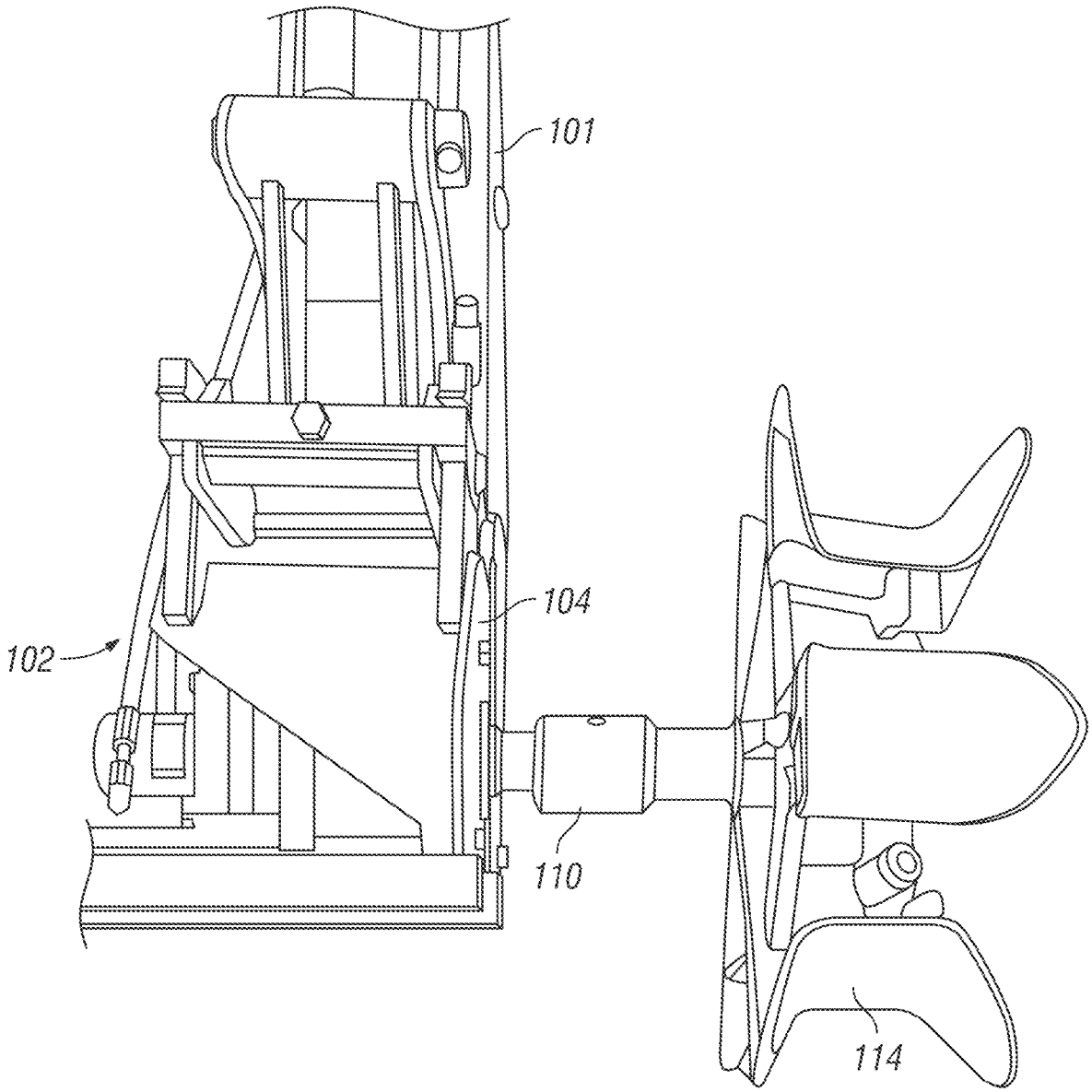
FIG. 1C is a front side view of the cable pulling apparatus of the present disclosure.

FIG. 1C a front side view of another exemplary cable pulling apparatus. The view provides an excavator 101 that is connected to the housing 102 via quick connects 103. The housing 102 has a first side wall 104 that allows the drive shaft 110 to extend out of an aperture in the first side wall 104. The drive shaft 110 is connected to the collapsible power reel 112. The collapsible power reel 112 has numerous segments 114 that extend from the collapsible power reel 112 radially.

To connect the housing 102 and the collapsible power reel 112, the drive shaft 110 extends in a horizontally from an aperture in the first side housing wall 104. FIG. 1C also illustrates an example of the locations of the motor and the collapsible power reel, with a portion of the motor extending through the second side wall of the housing. In configurations where the motor extends through the second side wall of the housing, the balance of the apparatus is improved. The motor and collapsible power reel provide substantially equal counterbalancing forces, thereby decreasing the stress on the apparatus and increasing pulling performance.

Figure 1D:
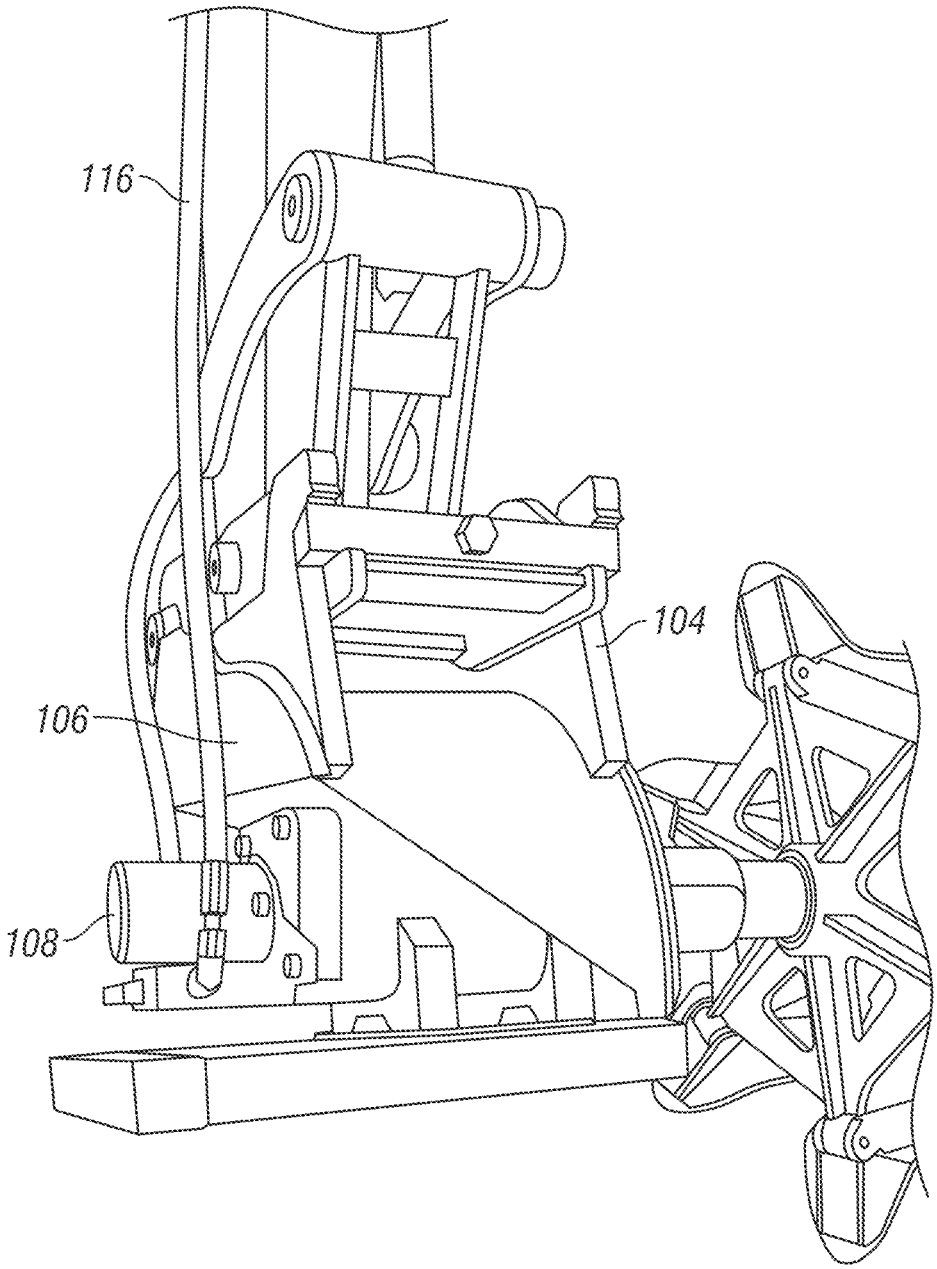
FIG. 1D is a front and left side view of the cable pulling apparatus of the present disclosure.

FIG. 1D a front and left side view of an exemplary cable pulling apparatus of the present disclosure. The view provides an excavator 101 that is connected to the housing 102 via a quick connect 103. The housing 102 has a first side wall 104 that allows the drive shaft 110 to extend out of an aperture in the first side wall 104. The drive shaft 110 is connected to the collapsible power reel 112. The collapsible power reel 112 has numerous segments 114 that extend from the collapsible power reel 112 radially. The housing 102 provides a foundation for the motor 108 on the second side wall 106 side of the housing. Adjacent to the first side wall 104 is a convertible power reel 112. A drive shaft 110 provides a connection between the motor 108 and the convertible power reel 112 through the housing 102. FIG. 1D also illustrates an example of the motor extending through the second side wall 106 of the housing, which improves the balance of the apparatus.

Figure 1E:
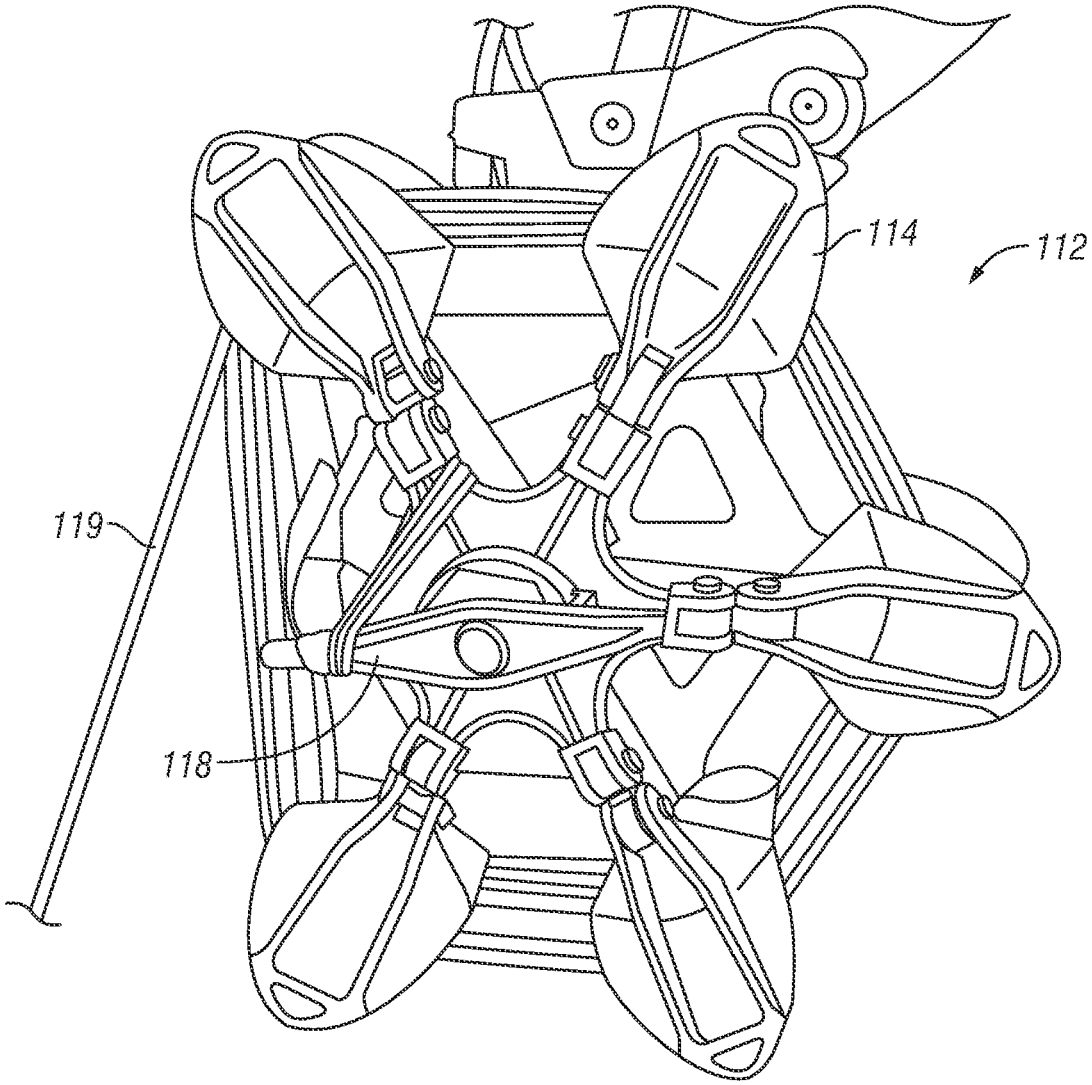
FIG. 1E is a right-side view of the cable pulling apparatus of the present disclosure.

FIG. 1E a right-side view of an exemplary cable pulling apparatus. The view illustrates the collapsible power reel 112 having numerous segments 114 that extend from the collapsible power reel 112 radially. The cable 119 is attached to power reel and wrapped around the segments. The size and number of segments 114 may vary. Additionally, the segments may be removable from the collapsible power reel 112. FIG. 1E illustrates an example of one of the segments 114 being removed. Removal of a segment 114 reduces the circumference of the power reel 112, allowing for the cable to be wound in various sizes. To ensure the cable 119 is attached during the pulling operation, an embodiment of the device could include an edge or fastener suitable for securing the cable on at least one segment 114. This edge or fastener when used to secure the cable 119 ensures that when in operation the cable 119 stays secured to the power reel 112 during the cable puller's 100 operation.

Figure 2:
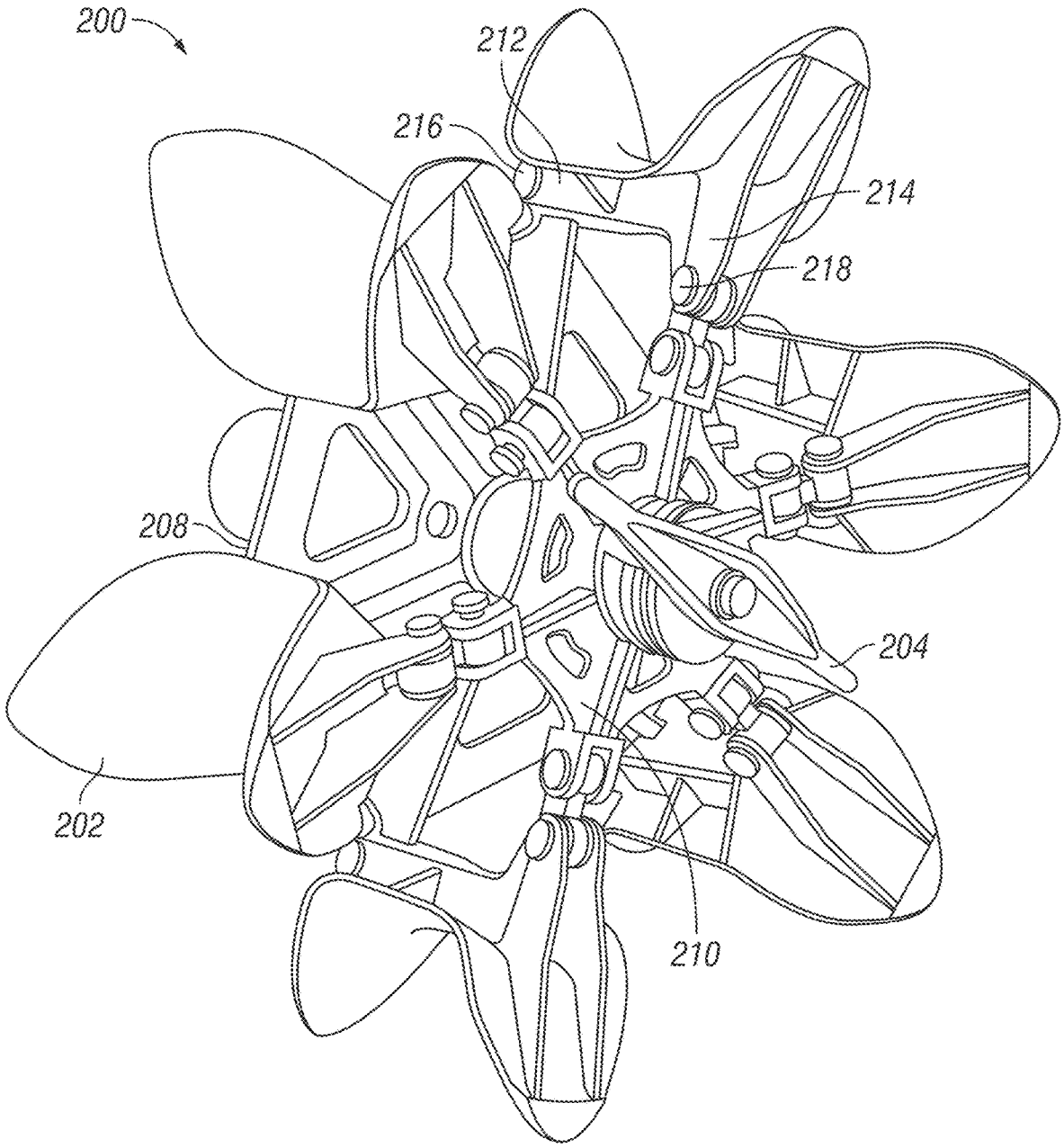
FIG. 2 is a front-side view of the collapsible power reel of the present disclosure removed from the other elements of the cable pulling apparatus of FIGS. 1A-1E.

FIG. 2 is a front-side view of an exemplary collapsible power reel of the present disclosure removed from the cable pulling apparatus of FIGS. 1A-1E. The power reel 200 is collapsible, allowing the segments 202 that extend radially to move inwards and outwards, altering the circular circumference of the segments. This view provides a separate perspective of the collapsible power reel 200. The segments 202 extend radially from the middle of the reel 200. The segments can be manipulated by a handle 204 when turned to either extend or limit the circumference formed by the segments 202. The handle 204 in the center of the collapsible power reel 200 manipulates the segments 202 through the spider pieces (alternatively referred to as rims) 208, 210 at the center of the collapsible power reel. The fixed spider (or second rim) 208 piece stays in place while the sliding spider (or first rim) 210 manipulates the segment 202 location when a user manipulates the handle 204. The changing circumference of segments 202 allow for cables to be removed from the power reel 200 without backing the cable off the reel (e.g., the wound cable slides off the segments). Also, segments 202 can be removed from the collapsible power reel 200 to limit the circumference of the segments 202. A cable can be wrapped around the segments 202 in a coil mirroring the circumference.

The collapsible power reel 200 can be detached from the device by way disengaging from the drive shaft. The collapsible power reel 200 is configured to interact with any cable on the radially extended segments 202. These segments 202 can be manipulated by a handle 204 when turned to either extend or limit the circumference formed by the segments 202. The handle 204 manipulates the segments 202. This manipulation happens as the segments 202 are connected to two links 212, 214 with locking pins (or fasteners) 216, 218 that can move from a vertical orientation pointed away from the central fixed spider piece 208 to horizontal with the turn of the handle 204, thereby decreasing the outward extension of the segments 202 away from the central spider piece 208. In other words, the altering of the link position by turning the handle 204 can decrease the overall circumference of the aggregate segments 202. The links 212, 214 and locking pins (or fasteners) 216, 218 are built into the central fixed spider 208 and the central sliding spider 210 that operate as the backbone of the power reel.

The handle is anchored into the center of the sliding central spider. Anchoring is completed by a screw that, through a spacer, spring, and a plug, is secured through the central sliding spider into the spindle. The spindle is fitted into the central fixed spider adjacent to the sliding spider. The spindle pieces include a spring, roll pin, and a nut to allow for connected operation of the handle. The spindle and handle are connected and secured together by the screw, so both pieces move in tandem. This movement facilitates the radial expansion or contraction of the segments. The loaded springs in the handle promote differing orientations of the links to alter the segments in a radial fashion. The links are connected to both spindles at apertures on the spindles.

While this disclosure has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Brief Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

What is claimed is:

1. A cable winding apparatus mounted on an arm of an excavator, the cable winding apparatus comprising:

a housing having a first side wall and a second side wall, wherein the first side wall comprises an aperture and the second side wall comprises an aperture;

a hydraulic motor disposed within the housing, wherein:

a portion of the hydraulic motor extends through the aperture of the second side wall of the housing, the hydraulic motor is connected to a first end of a drive shaft, and a second end of the drive shaft extends through the aperture of the first side wall of the housing; and a collapsible power reel connected to the second end of the drive shaft such that the collapsible power reel is positioned entirely outside of the housing, wherein:

the collapsible power reel comprises a plurality of segments movably coupled to the collapsible power reel and extending radially from the collapsible power reel, the plurality of segments are configured to engage the cable, thereby enabling the cable to be wound around the collapsible power reel as the hydraulic motor rotates the collapsible power reel, the collapsible power reel and the portion of the hydraulic motor extending through the aperture of the second side wall of the housing balance the apparatus while the collapsible power reel winds the cable, and the plurality of segments are configured to collapse in an axial direction, thereby enabling the wound cable to be removed from the apparatus.

2. The cable winding apparatus of claim 1, wherein:

each of the plurality of segments comprise a first link and an opposing second link, the first and second link extending radially inward;

the collapsible power reel further comprises a first rim, an opposing second rim, and a handle;

the first rim comprises a first set of fasteners, the second rim comprises a second set of fasteners, each of the first set of fasteners is coupled to a corresponding first link, and each of the second set of fasteners is coupled to a corresponding second link; and the handle is disposed on the first rim and engaged with the first set of fasteners, whereby turning the handle moves the plurality of segments between extending radially and extending axially.

3. The cable winding apparatus of claim 2, wherein one segment of the plurality of segments is configured to engage with a portion of the cable for winding the cable around the collapsible power reel.

4. The cable winding apparatus of claim 1, wherein one segment of the plurality of segments is configured to engage with a portion of the cable for winding the cable around the collapsible power reel.

5. The apparatus of claim 1, wherein the motor is positioned entirely outside the housing.

6. The apparatus of claim 1, wherein the housing is releasably coupled to the excavator via a quick connect.

7. The apparatus of claim 1, wherein the collapsible power reel is releasably coupled to the drive shaft via a quick release.

8. The apparatus of claim 1, wherein a gearbox is located approximately on or in the motor.

9. The apparatus of claim 1, wherein a cable is a wire, and wherein attaching the wire comprises wrapping a portion of the wire around at least one edge of the one segment.

10. The apparatus of claim 1, wherein a cable is a rope, and wherein attaching the rope comprises wrapping a portion of the rope around at least one edge of the one segment.

11. The apparatus of claim 1, wherein the plurality of segments consists of six segments; and prior to operating the motor, one or more of the six segments is removed, thereby enabling the rope to be wound around a smaller area.

12. A method of winding a cable with an apparatus attached to an excavator, the apparatus comprising a housing and a collapsible power reel, wherein the housing comprises a motor at least partially disposed therein, and wherein the collapsible power reel is connected to the motor via a drive shaft and positioned entirely within the housing, the method comprising:

attaching the cable to one segment of a plurality of segments extending radially from the collapsible power reel, wherein the plurality of segments are in an extended position;

operating the motor to spin the drive shaft, whereby the drive shaft spins the collapsible power reel;

winding the cable around the collapsible power reel as the motor spins the drive shaft, wherein winding the cable is devoid of an external source providing tension to the cable;

adjusting the plurality of segments from the extended position to a collapsed position, whereby the plurality of segments extend in an axial direction in the collapsed position; and removing the wound cable from the plurality of segments from the plurality of segments in the collapsed position.

13. The method of claim 12, wherein the cable is a wire, and wherein attaching the wire to the cable puller comprises wrapping a portion of the wire around at least one edge of the one segment.

14. The method of claim 13, further comprising:

prior to adjusting the plurality of segments, stopping the motor; and after the step of removing the wound cable, placing the plurality of segments in the extended position.

15. The method of claim 12, wherein:

the collapsible power reel comprises a handle connected to the plurality of segments, whereby turning the handle adjusts the plurality of segments between the extended position and the collapsed position; and adjusting the plurality of segments includes turning the handle in a counterclockwise direction to place the plurality of segments in the collapsed position.

16. The method of claim 12, wherein:

the one segment comprises a fastener; and attaching the cable to the one segment includes engaging the cable with the fastener.

17. The method of claim 12, wherein:

the cable is a rope;

the plurality of segments consists of six segments; and prior to operating the motor, removing one or more of the six segments, thereby enabling the rope to be wound around a smaller area.

18. The method of claim 12, wherein:

the plurality of segments consists of at least two segments; and prior to operating the motor, removing one or more of the segments, thereby enabling the cable to be wound around a smaller area.

19. The method of claim 12, wherein:

the collapsible power reel is coupled to the drive shaft via a quick connect; and after removing the wound cable from the plurality of segments, removing the collapsible power reel from the drive shaft via the quick connect.

20. The method of claim 19, wherein a position of the motor be adjusted such that the motor may extend entirely outside of the housing.

* * * * *